United States Patent [19]

Bosworth, Jr. et al.

[11] Patent Number: 4,546,977

[45] Date of Patent: Oct. 15, 1985

[54] RACQUET STRINGING MACHINE WITH IMPROVED RACQUET RETAINING STANDARD

[75] Inventors: Warren M. Bosworth, Jr., Glastonbury, Conn.; Fred E. Martin, San Diego, Calif.

[73] Assignee: Ektelon, San Diego, Calif.

[21] Appl. No.: 620,520

[22] Filed: Jun. 14, 1984

[51] Int. Cl.[4] ..... A63B 51/14

[52] U.S. Cl. ..... 273/73 A; 24/516; 269/166

[58] Field of Search ..... 273/73 A, 73 B; 269/166, 169, 268; 24/515, 516, 503, 504

[56] References Cited

U.S. PATENT DOCUMENTS

| | | | |
|---|---|---|---|
| 1,938,562 | 12/1933 | Tauber et al. | 273/73 A |
| 2,362,067 | 11/1944 | Heinrich | 269/169 |
| 2,424,313 | 7/1947 | Heinrich | 269/169 |

*Primary Examiner*—Richard C. Pinkham
*Assistant Examiner*—Matthew L. Schneider
*Attorney, Agent, or Firm*—Oldham, Oldham & Weber Co.

[57] ABSTRACT

A racket stringing machine utilizing an improved retaining standard for securing a racket to be strung in a fixed position. The retaining standard includes a vise portion and a clamp portion. The clamp portion has an attached rod that fits into a hole in the vise. The clamp portion serves to maintain the racket to be strung in a fixed position on the vise. The vise also includes a slot into which a dog is inserted. The dog bears against the clamp rod and fixes it in a particular location. A handle having a cam portion is also provided. The cam portion of the handle engages the dog so as to allow selective engagement with the clamp rod. Additionally, frame retainers of different sizes and shapes are provided that allow rackets of various configurations to be strung with the same stringing machine.

5 Claims, 7 Drawing Figures

RACQUET STRINGING MACHINE WITH IMPROVED RACQUET RETAINING STANDARD

TECHNICAL FIELD

The present invention lies in the field of racquet stringers and, in particular, to the retaining standards that secure the racquet onto the stringing machine. The present invention allows one stringing machine to be adapted to string a multiplicity of different makes and models of racquets.

BACKGROUND ART

In the past, most racquets, whether they be tennis, racquetball, squash, badminton, etc., have been of similar design. These similar designs led to racquet stringers that were adaptable to limited styles of racquets. Now, with the everchanging field of racquet sports, it is necessary for a change in stringing machines allowing them to adapt to different designs of racquets. Now that there are enlarged racquets, throatless racquets, racquets with different design throats, racquets of all shapes and sizes, the present invention is most needed to eliminate the stringing dilemma confronting racquet stringers.

DISCLOSURE OF INVENTION

It is an aspect of the present invention to allow stringing machines to string all makes and models of racquets.

Another aspect of the present invention is that it allows stringing machines to string enlarged head racquets.

Still another aspect of the present invention is that it is easily adaptable to existing stringing machines.

Yet another aspect of the present invention is the securing of the racquet by a sliding of a lever.

Still aother aspect of the present invention is a frictional locking means securing the racquet in place.

These and other aspects of the present invention are achieved by a racquet stringer, the improvement comprising: a retaining standard maintained onto said racquet stringer, a handle lever, an upper clamp, and a dog, whereas said handle lever, upper clamp and dog are maintained into said retaining standard by conventional means.

BEST MODE FOR CARRYING OUT THE INVENTION

Figure 1:
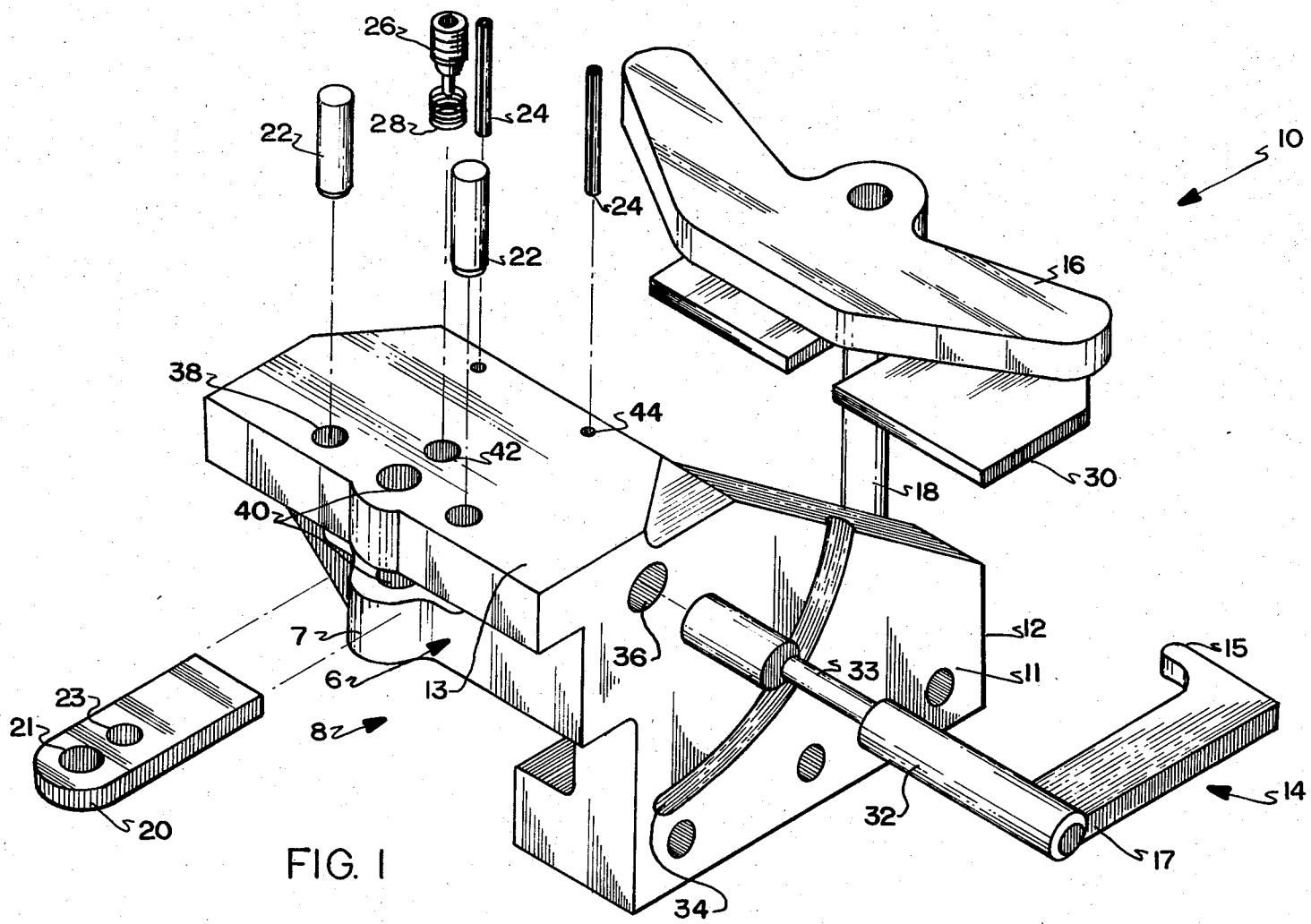
FIG. 1 is an objective exploded view of the retaining standard, and associated attachments.

FIG. 1 illustrates an exploded view of the retaining standard 10. It includes a vise 12 which in uniquely shaped having several apertures, grooves and slots therein. The vise 12 can be of varying polygonal shapes and designs. The vise 12 has a smooth horizontal top surface 13. The top surface has several apertures and is of a polygonal shape. The vise side 11 is a smooth, vertical, polygonal surface having a plurality of apertures and also a groove 34. The vise front 8 is polygonal with a cylindrical protrusion 7 and a dog slot 6. The vise 12 may be made up of any plastic or metallic material, preferably a casting type material such as aluminum or steel. The vise 12 is preferably cast, although it could be machined. The handle 14 has a lever portion 17 and a cam portion 32. The lever 17 is L-shaped, with a protruding tip 15. The cam portion 32 is a cylindrical rod. It is broken into three segments, the center segment 33 also being a cylindrical rod but being smaller than the rod and also being offset from the center of the rod which provides the "cam action." The cam portion 32 is placed into the aperture 36 on the vise 12. The portion is journaled into the vise 12 and rotates freely within the aperture 36. When the handle 14 is in place in the vise 12, the lever tip 15 swings freely in the vise groove 34, as can best be seen in FIG. 2. The dog 20 is a thin, slender member having a square end and the other end being semi-circular. The dog 20 has two apertures. The dog 20 is secured within slot 6 in the vise 12 by first placing a spring 28 into the aperture 42. The dog is then slid into the dog slot 6 over top of the spring 28 and then the set screw 26 is placed into the aperture 42 and threadedly secured in the aperture 42. The set screw 26 has a threaded portion on its top and a cylindrical nonthreaded pivot portion on its bottom, which penetrated dog aperture 23 and the center of spring 28. The upper clamp 16 is of a flattened boomerang configuration with a circular protrusion at its center. The upper clamp 16 is used to hold the racquet in position. The clamp rod 18 is maintained in the upper clamp 16 by conventional means. The clamp rod 18 is a slender cylindrical member and is sized to meet the dimensions of the vise 12. The upper clamp 16, with the clamp rod 18 in position, is then inserted into aperture 40, through the vise, through the dog, aperture 21 and out the other side of the vise 12. A protective pad 30 (sometimes of leather) is affixed to the upper clamp 16. The pad 30 serves to protect the racquet so that it is not damaged or scratched when the upper clamp 16 is secured. A plurality of dowl rods 22 and 24 are maintained into the vise top 13. These rods 22 are slender, cylindrical members used to position the selected frame retainer 60–64. Rods 24 serve to maintain dog 20 alignment.

Figure 2:
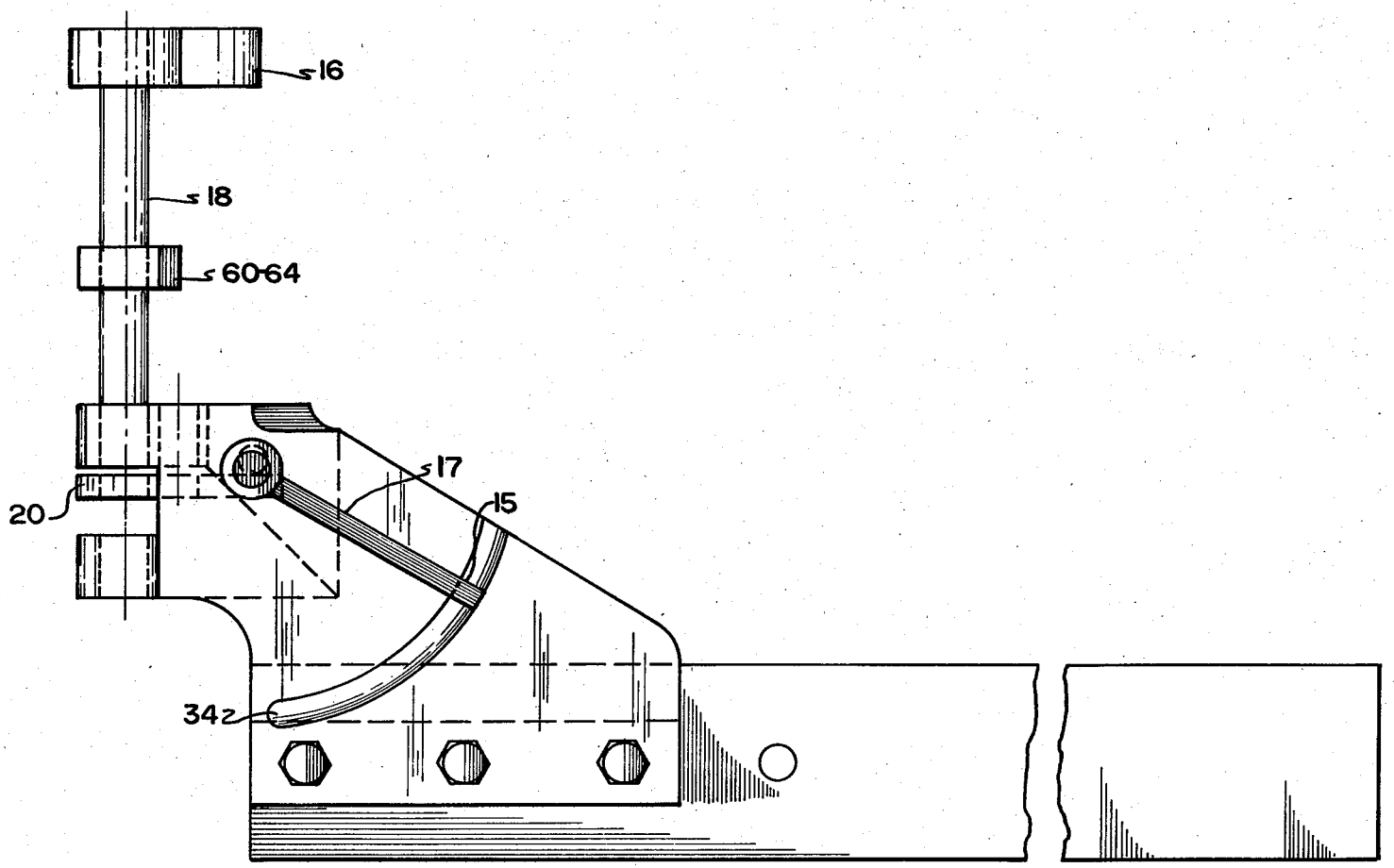
FIG. 2 is a side view of the retaining standard.
Figure 3A:
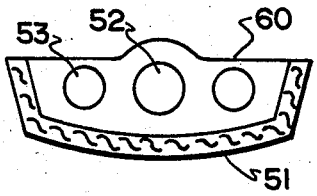
FIGS. 3A–3E show views of a plurality of "frame retainers".
Figure 3B:
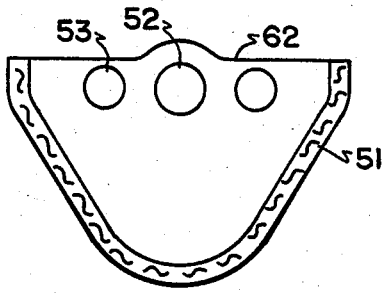
Figure 3C:
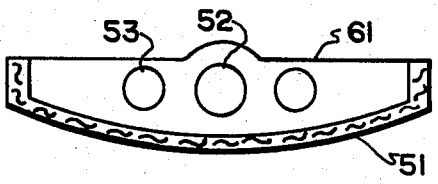
Figure 3D:
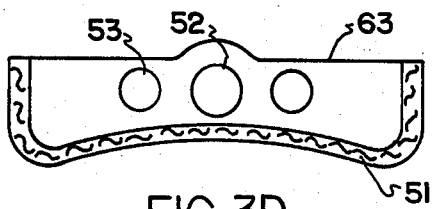
Figure 3E:
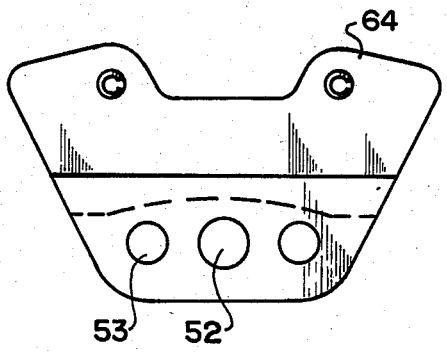
Figure 3E:
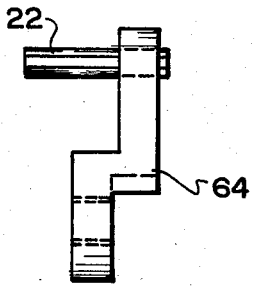

FIG. 2 illustrates the inserting of the upper clamp 16 into the aperture 40. A frame retainer 60–64 is placed onto the rods 22 prior to inserting rod 18 through apertures 52, 40 and 41. The racquet retainer comes in a plurality of different shapes and models as can be seen in FIG. 3. The different frame retainers 60–64 allow the stringing machine to fit all of the different makes and models of racquets desired.

FIG. 3 illustrates a plurality of frame retainers 60–64. The retainers 60–64 possess three apertures, 52 and 53, and are lined with a cushioning pad 51. The apertures enable the retainer 60–64 to fit onto the dowl rods 22 and accept the clamp rod 18. The frame retainers 60–64 are designed so that they will fit standard yoke, plastic yoke with guides, racquetball and squash, reverse curved yoke and noncurved yoke, the Wilson T-X000, and deep V-frame type of racquet frames. As can be seen, the retainers 60–64 vary in shape and design from a rectangular type design with wings, which fits standard type yokes, to a protruding D-shaped design for deep V-frames, and a split up and down rectangular V-shaped retainer for the Wilson T-X000 series.

As outlined above in viewing FIG. 1 and FIG. 2, the dog 20 is secured into the dog slot 6, the dowl rods 22 and 24 are placed into their corresponding apertures, the handle 14 is then placed into its corresponding aperture 36 and slid into the vise, with the slender spindle 33 being on top of the dog 20. The frame retainer 60 is then slid over the dowls 22 thus, the retaining standard 10 is ready to receive a racquet frame. The racquet frame is placed onto the vise top 13. Then, the clamp rod 18 is slid into the aperture 40. The upper clamp 16, which is permanently affixed to the clamp rod 18, is then aligned on top of the racquet frame. Prior to the insertion of the clamp rod 18, the handle lever 17 is then moved to its uppermost position, whereas the lever tip 15 is up in the air and is not in the vise groove 34. The handle lever 17 is pulled downwards into the vise groove 34, thus causing the slender spindle 33 to rotate down on top of the dog 20 causing the dog aperture 21 to frictionally affix on the clamp rod 18 which in turn pulls down on the clamp rod 18, locking the upper clamp into position. Therefore, this frictional locking secures the upper clamp into position, holding the racquet frame onto the stringing machine and now the racquet frame is ready for the stringing procedure.

Certain modifications could be made to the present invention, design, dimension and proportion of different parts, which are described and illustrated herein without departing from the scope and spirit of the present invention. For the true scope and breadth of the invention, reference should be had to the appended claims.

What is claimed is:

1. In the combination of a racket stringing machine and a retaining standard, the improvement comprising:

a retaining standard for securing a racquet to be strung in a fixed position, said retaining standard comprising:

a vise having a slot and a plurality of apertures;

a clamp for holding a racquet in position, said clamp having a clamp rod extending from said clamp and into one of the apertures in said vise;

a dog located in said slot for holding and securing said clamp rod in a fixed position;

a handle lever attached to a camshaft, said camshaft being located in one of said apertures in said vise;

a frame retainer between said vise and said clamp; and means for maintaining said frame retainer in desired alignment with respect to said vise.

2. An improvement in a racquet stringer as in claim 1 wherein said vise has an arcuate groove and said handle lever has a protruding portion which is freely slidable in said groove.

3. An improvement in a racquet stringer as in claim 1 wherein said means for maintaining said frame retainer in desired alignment includes a plurality of rods located in apertures in said vise and extending into apertures in said frame retainer.

4. An improvement in said racquet stringer as in claim 1 wherein said retaining standard includes a spring and pivot means for securing said dog in said slot.

5. An improvement in a racquet stringer as in claim 1 wherein the frame retainer is shaped to correspond to the shape of the racquet being strung.

* * * * *